US006811731B2

(12) United States Patent
Archer et al.

(10) Patent No.: US 6,811,731 B2
(45) Date of Patent: Nov. 2, 2004

(54) METHODS OF INCORPORATING PHOSPHATE/BORATE FIRE RETARDANT FORMULATIONS INTO WOOD BASED COMPOSITE PRODUCTS

(75) Inventors: Kevin J. Archer, Charlotte, NC (US); Kenneth D. Roos, Nicollet, MN (US)

(73) Assignee: Chemical Specialties, Inc., Charlotte, NC (US)

( * ) Notice: Subject to any disclaimer, the term of this patent is extended or adjusted under 35 U.S.C. 154(b) by 334 days.

(21) Appl. No.: 10/038,522

(22) Filed: Oct. 23, 2001

(65) Prior Publication Data

US 2003/0068441 A1 Apr. 10, 2003

Related U.S. Application Data

(60) Provisional application No. 60/274,875, filed on Mar. 9, 2001, and provisional application No. 60/242,505, filed on Oct. 23, 2000.

(51) Int. Cl.[7] ..... B27N 3/00
(52) U.S. Cl. ..... 264/109; 524/14
(58) Field of Search ..... 264/109; 524/14

(56) References Cited

U.S. PATENT DOCUMENTS

| | | | | |
|---|---|---|---|---|
| 2,917,408 | A | 12/1959 | Goldstein et al. | 117/103 |
| 3,159,503 | A | 12/1964 | Goldstein et al. | 117/137 |
| 3,874,990 | A | 4/1975 | Surdyk | 161/261 |
| 3,887,511 | A | 6/1975 | Juneja | 260/29.4 |
| 3,986,881 | A | 10/1976 | Oberley | 106/15 FP |
| 4,010,296 | A | 3/1977 | Oberley | 427/393 |
| 4,461,720 | A | 7/1984 | Loyvet et al. | 252/607 |
| 4,725,382 | A | 2/1988 | Lewchalermwong | 252/607 |
| 5,064,689 | A | 11/1991 | Young, Sr. et al. | 427/202 |
| 5,094,890 | A | 3/1992 | Smith et al. | 427/393 |
| 5,151,225 | A | 9/1992 | Herndon et al. | 252/607 |
| 5,185,214 | A | 2/1993 | LeVan et al. | 428/541 |
| 5,395,656 | A | 3/1995 | Liang | 427/393 |
| 5,593,625 | A | 1/1997 | Riebel et al. | 264/115 |
| 5,817,369 | A | 10/1998 | Conradie et al. | 427/389.9 |
| 6,569,540 | B1 * | 5/2003 | Preston et al. | 428/537.1 |

* cited by examiner

*Primary Examiner*—Mary Lynn Theisen
(74) *Attorney, Agent, or Firm*—McAndrews, Held & Malloy

(57) ABSTRACT

A fire-retardant wood-based composite is formed by treating a green wood furnish with an amount of a phosphate/borate fire retardant treatment effective to increase the fire retardancy of the resulting wood-based composite, compared to the fire retardancy of the corresponding wood-based composite lacking the fire retardant. The fire retardant treated green wood furnish is blended with a binder and then bound, as by pressing the furnish, to form a non-leaching fire-retardant wood based composite. Another aspect of the invention is the product formed according to the preceding process. The fire retardant may also act as a catalyst to cure the binder and thus promote binding. Also, the addition of the fire retardant to green wood chips, without the need to dry them to a low moisture content, is believed to be novel.

13 Claims, 1 Drawing Sheet

Figure 1:
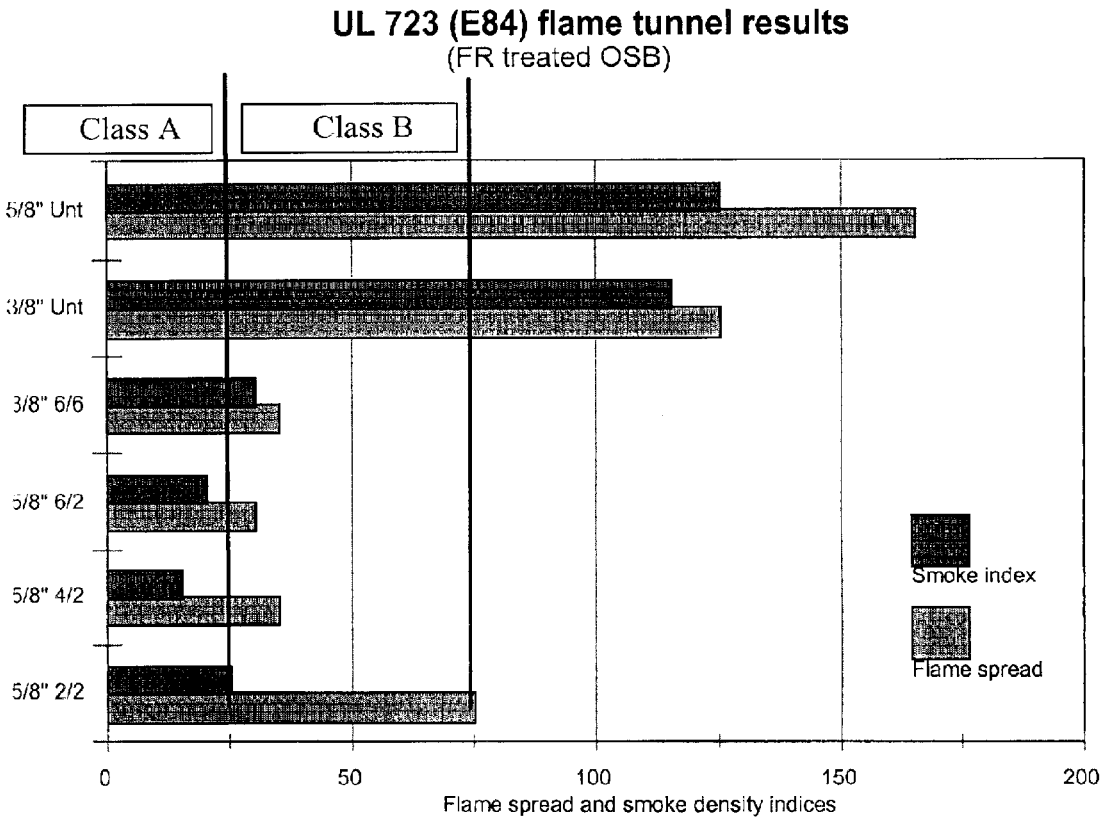

METHODS OF INCORPORATING PHOSPHATE/BORATE FIRE RETARDANT FORMULATIONS INTO WOOD BASED COMPOSITE PRODUCTS

CROSS-REFERENCE TO RELATED APPLICATIONS

Priority is claimed from provisional applications U.S. Ser. No. 60/274,875, filed Mar. 9, 2001, and U.S. Ser. No. 60/242,505, filed Oct. 23, 2000, now pending.

STATEMENT REGARDING FEDERALLY SPONSORED RESEARCH OR DEVELOPMENT

Not applicable.

BACKGROUND

This invention relates to the incorporation of fire retardant treatments into wood composite products such as oriented strand board, medium density fiberboard, fiber board and particle board. The invention also relates to the method of manufacturing wood based composite products whereby fire retardant compositions are added to the wood furnish prior to drying, forming and pressing into a finished board or panel product. (A "wood furnish" is defined as wood strands, chips, particles, flakes or fibers. "Wood particles" are defined broadly in this specification to include webs of splintered wood formed by twisting or crushing billets of wood, as well as other forms of wood particles.) The invention further relates to the products made by these processes.

The production of wood based composite panel products has increased dramatically in recent years. Oriented strand board (OSB) production exceeded that of plywood in 2000. In order to continue this new growth, additional uses for OSB need to be developed. Composite wood products find application in the construction of residential housing and commercial buildings. Common applications for these products include roof sheathing, wall sheathing, flooring, structural insulated panels and engineered wood components such as I-joists. With the ever expanding production capacity of wood based composites there is a critical need to find additional uses. One such possibility is for structural and non-structural building components to be made resistant to fire. However, by virtue of their lignocellulosic composition, wood based composites are inherently susceptible to combustion.

Chemical preservatives and fire retardant treatments are readily available for solid lumber and plywood. Such chemical treatments are applied to lumber and plywood using vacuum pressure processes to ensure uniform distribution of the active ingredients throughout the wood components thereby guaranteeing optimum performance.

Historically, attempts to incorporate chemical treatments into wood based composites using similar technology have failed for economic reasons or more commonly because of technical problems associated with irreversible and excessive swelling of the treated panels and severe loss of structural integrity.

The development of an economically viable fire retardant treatment for wood based composites with minimal negative or no impact on board structural properties, would be desirable to the industry and consumer as whole.

The incorporation of a wood preservative in aqueous form directly into green wood particles, without first drying the wood particles, is disclosed in U.S. Ser. No. 09/550,027, filed Apr. 14, 2000.

SUMMARY OF THE INVENTION

One aspect of the invention is a method of forming a fire-retardant wood-based composite. The method includes the steps of providing a green wood furnish and treating the green wood furnish with an amount of a phosphate/borate fire retardant treatment effective to increase the fire retardancy of the resulting wood-based composite, compared to the fire retardancy of the corresponding wood-based composite lacking the fire retardant. The treated green wood furnish optionally is dried to a moisture content suitable for fabrication of the wood-based composite. The treated green wood furnish is blended with a binder and then bound, as by pressing the furnish, to form a fire-retardant wood based composite.

Another aspect of the invention is the product formed according to the preceding process.

One advantage of the present invention is that the aqueously applied fire retardant is not easily leached out of the composite board after treatment. This result is surprising. The fire retardant may also act as a catalyst to cure the binder and thus promote binding; this is also surprising. Also, the addition of the fire retardant in aqueous form to green wood chips, without the need to dry them to a low moisture content first, is believed to be novel, and saves the energy which would otherwise be expended by drying the green wood chips before treatment, then applying the aqueous fire retardant (and also rewetting the chips), and finally drying the chips a second time.

BRIEF DESCRIPTION OF DRAWING FIGURES

FIG. 1 is a plot of burn test results for the fire retardant treated oriented strand board samples of Example 3.

DETAILED DESCRIPTION

While the invention will be described in connection with one or more embodiments, it will be understood that the invention is not limited to those embodiments. On the contrary, the invention includes all alternatives, modifications, and equivalents as may be included within the spirit and scope of the appended claims.

While the present invention is exemplified by treating OSB, the invention will find application in other composite wood materials.

Broadly, the present OSB is made by providing a green wood furnish, treating the green wood furnish with a phosphate/borate fire retardant material, treating the furnish with a binder, and pressing the binder-treated furnish to form boards having the desired dimensions.

The green wood furnish can be prepared by various conventional techniques. For example, debarked pulpwood grade logs, or so-called roundwood, can be converted into a furnish in one operation with a conventional roundwood flaker. Alternatively, logs, logging residue, saplings, etc. can be cut into fingerlings in the order of 0.5 to 3.5 inches (1 to 9 cm.) long with a conventional device, such as a helical comminuting shear, and the fingerlings flaked in a conventional ring-type flaker. The woods are normally debarked prior to flaking.

More particularly, in one embodiment the strands are produced on waferizers and transferred to a primary green storage bin. From the primary green bin the strands are metered out and pass through a green screening operation to remove undesirable fine material. The strands are transferred from the green bin to a dryer chute at a continuous rate depending upon the floor speed of the bin, by means of picker rolls. These picker rolls fling the strands into the air effectively separating them from one another into individual flakes.

In addition, milling, planing, sanding, sawing, or other wood processing waste can be processed into a suitable wood furnish. These furnishes made from processed woods may already be classified adequately in size to avoid the need for classification as outlined above.

For best results with oriented wood composite products, the wood flakes should have an average length of from about 0.5 inch to about 5 or 6 inches (1-15 cm). The flakes can alternatively be about 1 inch to about 2 inches (3-5 cm) long. The flakes can have an average thickness of about 0.01 to about 0.05 inch (0.25 to 1.25 mm), alternatively about 0.015 to about 0.025 inch (0.38 to 0.63 mm), alternatively about 0.02 inch (0.5 mm). Flakes longer than about 3.5 inches (9 cm) may tend to curl which hinders proper alignment during mat formation, and it is difficult to insure that flakes shorter than about 0.5 inch (1 cm) do not become aligned with their grain direction cross-wise. Flakes thinner than about 0.01 inch (0.25 mm) tend to require excessive amounts of binder to obtain adequate bonding, and flakes thicker than about 0.05 inch (1.3 mm) are relatively stiff and tend to require excessive compression to obtain the desired intimate contact between them. In any given batch, some of the flakes generally will be shorter than 0.5 inch (1 cm) or longer than 6 inches (15 cm). The same is true for the width and thickness of the flakes. The size of the flakes is not regarded as critical, and the flake size may deviate from the above-stated sizes without departing from the scope of the invention. In particular, fibers having dimensions smaller than those provided above are commonly used for manufacturing medium density fiberboard. Particleboard is made from flakes having major dimensions of about 0.5 to 1 inch (12-25 mm) and a thickness of about 0.01 to 0.015 inch (0.25-0.4 mm).

To facilitate proper alignment in oriented wood composites like OSB, the flakes can be several times as long as they are wide, for example, about 4 to about 10 times as long. Using this constraint as a guide, the average width of the flakes generally can be from about 0.1 to about 2.5 inches (2.5 to about 64 mm), alternatively from about 0.1 to about 0.5 inch (2.5 to 13 mm), and their average thickness can be about 0.015 to about 0.025 inch (0.38 to 0.63 mm). In one embodiment, elongated wood flakes can be provided predominantly having a grain direction extending generally parallel to their respective longitudinal axes. The flakes can have an average length of about 0.5 inch to about 5 or 6 inches (1-15 cm), an average length to average width ratio of about 4:1 to about 10:1, and an average thickness of about 0.01 to about 0.05 inch (0.25 to 1.25 mm). Again, these numbers are typical, but not critical to practicing the present invention. Non-oriented products like particleboard and medium density fiberboard can be made from more compact flakes that can be about as wide as they are long.

The wood furnish of oriented wood composite products can be assembled or maintained as one or more strata or layers. In a layer, the furnish can have a grain direction extending generally parallel to the machine direction—the direction of travel of wood through the process. In one oriented strandboard embodiment contemplated here, at least 90% of the particles in the wood furnish are oriented in the recited manner.

The present inventors have discovered that a green wood furnish having a high moisture content can usefully be employed in the present process, which eliminates or materially reduces the need, and thus the cost, of pre-drying the furnish. For the purpose of the present disclosure, "green wood" includes both (1) wood that has not been dried; and (2) wood that has been dried and has been rewetted to a moisture content of at least about 30% MC. The use of a green wood furnish ensures that the penetration of the FRT is maximized.

The fiber saturation point of wood, at which the fibers are saturated with water, is generally considered to be about 30% moisture content (based on dry wood weight), dependent on species. The moisture content of a green wood furnish commonly exceeds the fiber saturation point. The present fire retardants work at moisture contents both below or above the fiber saturation point. Thus, the present method can be carried out using either the dried furnish of the prior art or a furnish containing any amount of moisture, including moisture levels characteristic of green flakes.

The moisture content of the green wood furnish just before treatment may be at or above the saturation point of the wood, alternatively on the order of from about 30% to about 100% by weight (based on the weight of dry wood), alternatively from about 40% to about 100% by weight. The moisture content may optionally be from about 60% to about 80% by weight, optionally from about 50% to about 70% by weight, based on the weight of dry wood. Moisture contents outside these ranges that are found in green wood are also contemplated. In contrast, the moisture content to which the furnish is dried traditionally has been in the order of from about 20 weight % to about 3 weight % or less, based on the dry weight of the furnish.

The fire retardants contemplated herein are phosphate/borate composite compositions. One class of these compositions employs an inorganic monobasic, dibasic, or tribasic phosphate with the borate. Examples of suitable phosphates include alkali metal phosphates, alkaline earth metal phosphates, ammonium phosphates, such as monoammonium phosphate or diammonium phosphate, or others. A system for incorporating an ammonium phosphate/borate fire retardant treatment (FRT) into the manufacturing process for wood based composites is disclosed in U.S. Pat. No. 4,725,382 (which is hereby incorporated herein by reference in its entirety for its description of fire retardant compositions and their use). Ammonium phosphate/borate fire retardant treatments (FRT) are commercially available from Chemical Specialties, Inc., Charlotte, N.C.

In addition to these inorganic phosphate/borate treatments, organic phosphate treatment agents can be used in combination with borates. The organic phosphates contemplated here include: 1) a combination of urea, dicyandiamide, phosphoric acid, and formaldehyde (UDPF) (see U.S. Pat. Nos. 5,185,214 and 3,887,511), 2) a combination of melamine, dicyandiamide, phosphoric acid, and formaldehyde (MDPF) (see U.S. Pat. No. 5,185,214), 3) a combination of dicyandiamide, phosphoric acid, and formaldehyde (DPF) (see U.S. Pat. Nos. 5,185,214 and 3,159,503); 4) the guanyl urea phosphates, including the aminoresins (see U.S. Pat. No. 5,395,656); 5) a combination of an amide, dicyandiamide and phosphoric acid (see U.S. Pat. Nos. 2,917,408 and 5,151,225); 6) a phosphate salt of methylolated guanyl urea (see U.S. Pat. No. 5,151,225); or 7) a combination of phosphoric acid, melamine or urea and formaldehyde (see U.S. Pat. No. 3,874,990). The portions of the patents cited in this paragraph pertinent to organic phosphates as fire retardants are hereby incorporated herein by reference. Other organic phosphates known to those skilled in the art may also be used.

U.S. Pat. No. 4,461,720 discloses another contemplated fire retardant. This fire retardant composition is prepared by first converting dicyandiamide to an aqueous guanyl urea solution. The guanyl urea solution is then methylolated and phosphoric acid is introduced in order to product a phosphate salt of the methyolated guanyl urea. This reference also describes a treatment solution made by combining urea; phosphoric acid; water; borax; boric acid; and sodium hydroxide. U.S. Pat. No. 4,461,720 also describes the preparation of guanyl urea phosphate and related compounds from dicyandiamide. These materials are contemplated to be useful as the phosphate component of a phosphate/borate fire retardant. The portions of the patents cited in this paragraph pertinent to organic phosphates as fire retardants are hereby incorporated herein by reference.

Other pertinent organic phosphate fire retardant compounds for wood are disclosed in U.S. Pat. Nos. 5,094,890; 4,010,296, and 3,986,881. The portions of the patents cited in this paragraph pertinent to organic phosphates as fire retardants are hereby incorporated herein by reference.

The addition rate for the FRT formulation may range from 2% m/m active ingredient to 20% m/m active ingredient defined on a $P_2O_5$ equivalent basis. The eventual fire resistance properties of the finished panel are proportionally linked to the weight percentage of FRT formulation incorporated into the furnish.

It is useful, after treating the particles with the fire retardant, to allow the particles to remain in contact with the treatment solution to give the stabilizer time to penetrate into the particles. This step is particularly contemplated if the particles are green and thus retain a substantial proportion of water. Contact time allows exchange between the water in the particles and the water containing the preservative and stabilizer, allowing diffusion of fire retardant salts into the particles. At least an hour of contact time is contemplated, though more or less contact time may be useful in given circumstances.

If necessary or desired in a given instance, the furnish can be partially dried prior to classification to prevent the wood particles from sticking together, thus assisting classification, or to provide other benefits. The chips nonetheless can be classified and used when they are very moist, and while they still meet one of the moisture content ranges contemplated above for the present invention.

The furnish can be blended with a fire retardant and optionally other additives at various points in the green wood process.

In one embodiment, from the green screening operation the strands move over a weigh belt and under a moisture detection device that is slaved to the green blending operation. The strands flow into a rotating blender. The fire retardant is applied at the desired active level based upon the weight and moisture content of the incoming furnish using an air atomizing spray system or coil spinning disc atomizing equipment. After treatment the furnish continues through the regular production process and is transferred into a drier, optionally via a secondary green bin.

In another embodiment, the airborne, separated strands leaving the picker rolls are sprayed with the fire retardant. The fire retardant chemical is applied with an airless or air assisted spray system set up to provide optimal coverage and distribution of the solution onto the surface of the flakes. Alternatively, if the volume of head space available is adequate, atomizers are used to apply the solution. The quantity of wood furnish (weight) moving through the green bin is determined by measuring or otherwise determining the wood feed speed and thus wood volume flow rate. The wood volume flow rate information is used to control the fire retardant application rates through a slaving device to a pump system. A moisture content measuring device can be incorporated into the feed back loop to ensure the accuracy of the wood flake flow rate. After treatment the furnish continues through the regular production process and is transferred into a dryer, optionally via a secondary green bin.

Alternatively, the FRT is applied by spraying or dipping the flakes with fire retardant solution as they exit the waferizer. In one embodiment, the fire retardant solution is sprayed at the interface of the log/disc head as the flakes are being cut. To facilitate accurately applying the FR chemical to achieve a desired loading, the wet weight of wood is measured with a weigh belt as the logs are transferred down the feed conveyor to the flaker. The wood moisture content is estimated from variables such as the season, time from felling, and other factors known to those skilled in the art to estimate the wood weight going through the waferizer. A pumping/spray system is slaved to the wood weight data to control the application rate. Once treated the strands continue through the OSB process.

Yet another alternative is to apply the FRT in dry, powdered form to the green flakes, which has the potential to still further reduce the amount of water that must be dried from the flakes. The water in the green flakes, particularly the water expressed when the flakes are pressed to form a board, solubilizes or transports at least part of the FRT into the flakes.

Still other methods for incorporating the FRT into green wood chips will be readily devised by a person of ordinary skill in the art, in view of the present disclosure.

The resultant furnish is formed into a loosely felted, layered mat (single or multi-layered), which may be made continuously in a roller process or as discrete billets in a molding process. Sufficient pressure (with or without heat) is applied to the mat by a roller, press, or other means to compress it to the desired thickness and shape for the structural member being made and to bond the wood furnish together.

Other additives, such as coloring agents, stabilizing ingredients, and the like may also be added to the particles before, during, or after the fire retardant blending step.

The FRT treated furnish is dried using conventional drying equipment to a moisture content appropriate to the type of resin system that will be used and the composite that will be made. This can range from 0.5% to 25% MC based on the oven-dry density of the furnish.

The moisture resistance of the structural member can be improved by spraying a liquid wax emulsion onto the particles during or after the stabilizer blending step. The wax can be, for example, the aliphatic or paraffinic petroleum product commonly known as slack wax. Slack wax is the wax recovered from a petroleum hydrocarbon by either solvent or propane dewaxing, and can contain entrained oil in an amount varying up to about 50%, alternatively 35% oil. This is the first waxy material separated in the refining of crude oil.

Molten or emulsified wax is applied to the particles. The amount of wax added generally is about 0.5 to about 5 weight %, as solids, based on the dry weight of the particles. Alternatively, the amount of wax can be at least about 1% of the oven dry weight of the wood particles. Alternatively, the amount of wax can be at least about 2% of the oven dry weight of the wood particles. The wax or other water repellant may be added after the FRT or with the FRT, but preferably is not added before the FRT. It is contemplated that adding the FRT no later than the water repellant allows the FRT to penetrate deep into the particles, before the water repellant excludes it.

In one contemplated embodiment, the wood particles are treated with the fire retardant, then with the wax, then dried.

Another step in the process is the application of a suitable binder or adhesive to bind the wood particles together. Suitable binders include those used in the manufacture of oriented strandboard, particleboard, fiberboard, and other chemical wood particle bonding systems. Resinous oriented strandboard binders presently are preferred. Representative examples of suitable binders include thermosetting resins. Other resins may also be utilized.

The specific resins that may be used include phenolic, urea formaldehyde (UF), phenol formaldehyde (PF) in a liquid or powder state, liquid melamine urea formaldehyde (MUF), resorcinol-formaldehyde, melamine-formaldehyde, urea-furfural, condensed furfuryl alcohol, acid catalyzed PF resins (commonly known as Novalac resins) isocyanate (MDI), or combinations of those resins. The particular type of binder used depends primarily upon the intended use for the structural member. For instance, structural members made with urea-formaldehyde resins have sufficient moisture durability for many uses that involve minimal exposure to moisture, but generally cannot withstand extended outdoor exposure. Phenol-formaldehyde and melamine-formaldehyde resins provide the structural member with durable properties required for long-term exterior applications.

Addition rates may vary from 1% to 15% resin solids depending on panel type and application. Ideally a PMF (Phenol-melamine-formaldehyde) adhesive, for example ARC-9707, is used in the addition rate of 2-15% active. More ideally the resin should be used at an addition rate of 3-8% active. Under normal circumstances the use of this resin dictates the use of an acid catalyst. Catalyst addition rates that are typically recommended for this purpose can vary from 0.5% to 15% on a liquid to liquid basis. Before this invention was made, ideally the addition rate was from 3-9% on a liquid to liquid basis. As has been explained further below, the catalyst can be reduced, or in some instances eliminated, when practicing the present invention.

The binder can be admixed with the particles in either dry or liquid form. To maximize coverage of the particles, the binder can be applied by spraying droplets of the binder in liquid form onto the particles as they are being tumbled or agitated in a blender. A web of loosely consolidated particles can be dipped through a bath of the binder or sprayed with the binder. The binder may also be introduced into a mold, preceded or followed by insertion of a charge of particles to be bound together in the mold. Foaming techniques may be applied to foam the resin to assist in spreading the resin and to fill any voids that might occur between the particles, while minimizing the amount of water employed in the process or taken up by the particles.

Any processing equipment can be used to prepare the treated wood particles. For example, the particles can be circulated in a rotating drum mixer and sprayed with the FRT, wax, and binder using one or more Coil spinning disc atomizers.

The particles are formed by suitable apparatus into a generally flat, loosely-felted mat, having one or more layers, and the mat is placed in a suitable press and compressed to consolidate the wood particles into a structural member of the desired size and cross-sectional shape. For example, the particles can be deposited on a plate-like carriage carried on an endless belt or conveyor from one or more hoppers spaced above the belt in the direction of travel. When a multi-layered mat is formed, a plurality of hoppers is used with each having a dispensing or forming head extending across the width of the carriage for successively depositing a separate layer of the particles as the carriage is moved beneath the forming heads.

The process can be carried out on a batch basis, i.e. individual sheets of the wood composite can be molded by treating an appropriate volume of particles with the binder resin combination and heating and pressing the treated material. Alternatively, the process can be carried out in a continuous manner by feeding treated particles in the form of a continuous web or mat through a heating and pressing zone defined by upper and lower continuous steel belts, through which the necessary heat and pressure are applied.

The mat thickness will vary depending upon such factors as the size and shape of the wood particles, the particular technique used in forming the mat, the desired thickness and density of the structural member or component, and the pressing pressure used. The mat thickness usually is about 5 to 6 times the final thickness of the structural member or component. For example, for a structural component having a 1-inch (2.5 cm) thickness and a density of about 40 lbs/ft$^3$ (0.64 g/cm$^3$), the mat usually will be about 5-6 inches (about 13-15 cm) thick. If the mat is thicker than about 25-30 inches (64-76 cm), it usually must be partially pre-compressed to a reduced thickness, with rollers or the like, prior to introduction into the press.

Pressing temperatures, pressures, and times vary widely depending on the thickness and the desired density of the structural member or component, size and type of wood particles, moisture content of the particles, and the type of binder. The pressing temperature used is sufficient to at least partially cure the binder and expel water from the mat within a reasonable time period, without charring the wood. Generally, a pressing temperature ranging from ambient (for room temperature-curable binders) up to about 450° F. (230° C.) can be used. Temperatures above 450° F. (230° C.) can cause charring of the wood particles. A pressing temperature of about 350° F. (175° C.) to about 425° F. (220° C.) is generally preferred for phenol-formaldehyde resin binders.

The pressure should be sufficient to press the wood particles into intimate contact with each other without crushing them to the point causing a breakdown of fibers with a resultant degradation in structural integrity. The pressure usually is about 325 to about 500 psig (224 to 345 N/cm$^2$).

The pressing time is sufficient to partially cure the binder to a point where the structural member or component has sufficient integrity for handling. The press cycle typically is about 2 to about 20 minutes; however, longer times can be used when pressure-curing binders are employed or when more complete curing of thermosetting binders is desired.

The pressed boards may be cooled, stacked to allow time and air circulation, and sanded to uniform smoothness and thickness, as is conventional.

When fire retardant treated flakes are used in combination with the PMF resin system described above, the level of catalyst needed to cure the resin can be reduced, and potentially reduced to zero, while at the same time permitting the manufacture of boards with excellent mechanical and physical properties as will be demonstrated later in Example 3.

The dry treated furnish is sprayed with resin and wax, formed and oriented into a mat of the desired thickness and pressed into the final panel. The physical and structural characteristics of the FRT enhanced wood based composite can be equivalent in magnitude to similarly manufactured but untreated composites.

Mats are formed to suit the type of composite and desired end use. Formed mats are pressed under heat and pressure conditions appropriate to the final end use of the finished board. Typical press parameters include consolidation pressures ranging from 50 psig (35 N/cm$^2$ gauge pressure) to 650 psig (450 N/cm$^2$ gauge pressure), cook pressures from 0 psig (0 N/cm$^2$ gauge pressure) to 400 psig (275 N/cm$^2$ gauge pressure), and a de-gas segment. Typical press temperatures vary from 200° F. (93° C.) to 550° F. (290° C.), depending on the type of composite. Press time may vary from 1 minute to 20 minutes duration.

The fire resistance of wood based composites can be enhanced if panels that are integrally treated using the invention described above are also surface treated by spray or dip application with an intumescing type fire retardant formulation.

Examples illustrating several applications of the invention using oriented strand board as the matrix are presented below.

EXAMPLE 1

Development of a Class One Fire Rated Oriented Strand Board Panel

An oriented strand board panel product that would meet or exceed Class one flame spread characteristics and pass American Plywood Association (APA) or equivalent physical and mechanical panel property testing would be highly desirable. Potential uses for this type of panel product include web stock for engineered wood I-beams; sheathing and roofing in commercial buildings; and various uses in multi-unit residential housing applications.

This Example was designed to evaluate the impact FRT loading on flame spread indices and smoke generation as well as impacts upon mechanical and physical panel properties.

CSI's Comptrol™ formulation was selected as the candidate FRT treatment although other phosphate/borate fire retardant formulations are contemplated to be equally applicable to this invention.

Comptrol™ is a patented (U.S. Pat. No. 4,725,382) ammonium phosphate/borate based fire retardant treatment that is clear in appearance. The nominal active ingredient content in the concentrate is of 23.7% based on $P_2O_5$ equivalence. All subsequent references to Comptrol™ loadings will be made on a $P_2O_5$ equivalence basis.

Aspen strands were obtained from an OSB mill in northern Minnesota. The strands were primarily aspen with a limited percentage of white birch, red pine, and balm mixed in. On receipt from the mill it was determined that the strands were at a moisture content of 4% (oven-dry basis). To simulate wet end mill conditions, the strands were re-wetted to 50% moisture content, oven-dry basis in a 6 ft. diameter blender and allowed to sit for 24 hours to allow complete migration of the water into the cores of the strands.

Three different addition rates of the Comptrol™ FRT product (2, 4, and 8 percent m/m $P_2O_5$ equivalent) were evaluated in this Example, to determine the relationship between FRT loading and performance. Addition rates were based on active ingredient content of the Comptrol and oven-dry basis of the strands. Untreated control panels were included for comparison. Four panels were manufactured at each addition rate, including the controls. A total of 16 panels were made.

The Comptrol concentrate was sprayed on to the green (rewetted) strands in a rotating 6 ft. (2 meter) diameter blender. One hour after treatment the FRT treated strands were dried to a moisture content of 3-4% on an oven-dry basis in a laboratory dryer.

The resin used for this Example was a phenol-melamine formaldehyde blend (PMF) commercially produced by ARC resins (ARC 9707). Typically, the use of a catalyst (ARC 9700) is required with this resin. It has been determined from previous OSB laboratory studies utilizing ARC 9707, that a catalyst addition rate of 6.5% maximizes panel properties. This addition rate is based on liquid weight of the catalyst and liquid weight of the resin. A wax additive was also used in this Example as a dimensional stabilizer. The wax used was a typical petroleum based wax emulsion, supplied by Borden Chemical (EW 58S), with a solids content of 58%. Both resin and wax were applied in the same 6 ft. (2 meter) diameter blender that was used for re-wetting the strands and for treatment with Comptrol™.

The blender was equipped with a Coil EL-4 spinning disc atomizer. Resin and wax addition rates were held constant for all four panel sets. Target resin addition rate was 4.5%, based on resin solids and oven-dry weight of the strands and Comptrol™ mix. Wax addition rate was 1.0% based on wax solids and oven-dry weight of the aspen and Comptrol™ mix.

After resin and wax addition, the strands were hand formed with a random orientation into 24 inch by 24 inch (61 cm by 61 cm) mats onto tight woven screens to allow off-gassing during the pressing operation. The mats were homogenous, in that there was no differentiation between the core and face layers. Pressing was accomplished using a 100-ton (90 metric ton) Wabash lab press. Press platen temperature was 380° F. (190° C.). Panels were consolidated to target thickness of ½-inch (13 mm) in 30 seconds at 550 psig (380 N/cm$^2$). Pressure was reduced to 250 psig (172 N/cm$^2$) after one minute. Total press time was six minutes with an additional 30 seconds de-gas. The target density was elevated slightly from the industry standard 39 pcf (pounds per cubic foot) (0.63 g/cm$^3$) to 42 pcf (0.67 g/cm$^3$) to compensate for the solids loading of the FRT. Panels were hot stacked for 24 hours to allow for total resin cure prior to testing. Finally the test panels were trimmed to dimensions of 1 inch ×1 inch (25 mm by 25 mm) using a table saw.

The panels were tested for flame spread rating as well as mechanical and physical properties. Flame spread index was determined using a modified two foot (61 cm) tunnel test (ASTM D3806). Four specimens from each set were evaluated. A class one rating is desired which is equivalent of a flame spread index from 0 to 25. This is determined according to the length of the flame spread on a two foot (61 cm) specimen after a flame exposure of four minutes. The tested mechanical and physical properties included internal bond, stiffness (MOE), strength (MOR), water absorption, and thickness swell. ASTM protocols were followed for mechanical and physical panel testing.

The addition of the fire retardant changed the appearance of the finished panels in at least two ways. The first observation was that the overall color of the boards became a darker brown. The intensity of the brown increased with increasing fire retardant concentration. In addition, a bright yellow particulate deposit was observed randomly distributed on and around the flakes. The amount of the deposit present seemed to increase with increasing fire retardant loading. The yellow material was not easily dislodged by mechanical scraping and could not be washed off the surface of the boards with deionized water. Although they do not intend to be bound to the accuracy of this theory, the inventors believe that the product is formed from a reaction of the fire retardant with the resin/catalyst combination.

In addition to the visual changes in the treated panels test data revealed that the panel mechanical properties and flame spread properties of the treated panels were changed. The incorporation of the Comptrol™ FRT did not adversely affect the internal bond values at any of the addition rates (Table 1A). There was no significant ($P<0.05$) difference in internal bond values between controls or any of the addition rates of Comptrol™.

There was no significant ($P<0.05$) difference in the MOR (strength) of the four combinations evaluated (Table 1C). However, the MOE (stiffness) of the panels was influenced by increasing amounts of Comptrol™. There is a curvilinear relationship between Comptrol™ addition rate and stiffness. As the percentage of Comptrol™ was increased from 0-4%, the stiffness increased then tailed off at the 8% loading. This tailing off effect of the stiffness at 8% Comptrol™ loading may or may not be due to the addition rate. As indicated before, the resin used in this Example was an acid catalyzed material. The resin and catalyst levels were held constant for all four combinations. At the 8% loading of Comptrol,™ the addition of this fire retardant is believed to impart a catalytic effect on the resin cure rate given the parameters used in this study. Hence, the inventors contemplate that the catalyst level should be reduced to optimize bending properties at higher Comptrol™ loadings.

The impact on water absorption and thickness swell (WATS) values was an inverted curvilinear relationship (Table 1B). As the percentage of Comptrol™ increased to 4%, the thickness swell and water absorption decreased. At the 8% Comptrol™ loading, the values increased somewhat, but were still comparable to the control values.

Flame spread index (FSI) and gross smoke generation improved as the loading rate of Comptrol™ increased in the panel. Without the fire retardant treatment in the panel the flame spread result indicated that the test panels qualified for a class 3 (C) rating. In addition, significant amounts of smoke were generated during the test. The 2% loading rate of Comptrol™ produced panels with a class 2 (B) FSI, and with still a fair degree of smoke generated. At the 4% addition rate of FRT, an average FSI of 25, the upper limit of a class 1 (A) rated panel, was achieved. There was very little smoke generated. At the 8% addition rate of Comptrol™, a class 1 (A) FSI was easily achieved, with very little smoke generated.

From the results of this study, it can be concluded that the manufacture of a FRT rated OSB is viable, given an appropriate combination of resin, FRT, and pressing parameters.

TABLE 1A

Internal Bond

| Treatment Face/core (% m/m $P_2O_5$) | IB PSI (N/cm$^2$) |
|---|---|
| Control | 57.8 (39.9) |
| 2/2 Comptrol ™ | 54.9 (37.9) |
| 4/4 Comptrol ™ | 59.0 (40.7) |
| 8/8 Comptrol ™ | 50.4 (34.8) |

TABLE 1B

Water absorption/Thickness swell

| Treatment Face/core (% m/m $P_2O_5$) | Water absorption (%) | Thickness swell (%) |
|---|---|---|
| Control | 29.2 | 8.4 |
| 2/2 Comptrol ™ | 27.8 | 8.1 |
| 4/4 Comptrol ™ | 25.6 | 6.9 |
| 8/8 Comptrol ™ | 32 | 8.2 |

TABLE 1C

Static bending

| Treatment Face/core (% m/m $P_2O_5$) | MOR PSI (N/cm$^2$) | Stiffness PSI (KN/cm$^2$) |
|---|---|---|
| Control | 5390 (3716) | 957,000 (660) |
| 2/2 Comptrol ™ | 3930 (2710) | 1,030,000 (710) |
| 4/4 Comptrol ™ | 5150 (3551) | 1,170,000 (807) |
| 8/8 Comptrol ™ | 3728 (2570) | 918,000 (633) |

EXAMPLE 2

Evaluation of the Resin/Catalyst/Fire Retardant Interactions

Example 1 shows that the use of the phosphate/borate fire retardant in combination with the ARC PMF resin system created several very interesting and novel phenomena. In essence it appeared that under the physical conditions generated in the press a new and potentially novel material was created by the combination of resin, catalyst and fire retardant. Example 2 was designed to investigate that interaction in greater detail.

European patent application EPO91514A1 describes a novel liquid PMF resin system catalyzed by simple organic acids such as formic acid and citric acid. While the inventors do not intend to limit the claims according to the accuracy of this theory, the inventors believe that similar catalytic properties might be ascribed to simple low molecular weight inorganic acids such as phosphoric acid $H_3(PO_4)$, formed from the fire retardant phosphate components.

To evaluate the potential significance of these phenomena to the invention, series of small experiments were conducted as described below.

Impact of Catalyst Loading

A second series of panels was manufactured using the parameters and procedures defined in Example 1. Mixed aspen and birch flakes were sprayed with sufficient Comptrol™ concentrate such that the final loading in the finished panel was equivalent to 6% m/m $P_2O_5$ in both the face and core. After drying the treated flakes were divided into four equal sized batches. ARC 9707 resin was applied to each batch of flakes at an addition rate of 4.5%, based on resin solids and oven-dry weight of the strands and Comptrol™ mix. Similarly the amount of wax emulsion applied to each batch of flakes was kept constant at an addition rate of 1.0%. However the amount of resin catalyst applied was varied. No catalyst was incorporated into batch 1, 3% catalyst was applied to batch 2, 6% was applied to batch 3 and 9% was applied to batch 4. Resinated flakes were formed into 24 inch (61 cm) mats and pressed into panels. The finished lab panels were cut into test samples to determine the relative IB and strength and stiffness values. Results from the Example are presented in table 2. (Note that the press cycle and press temperature were held constant for all panels fabricated in this study)

It is well known from previous studies with untreated flakes that the PMF resin will not cure adequately without the use of an acid catalyst. The data reported in table 2 demonstrate it was possible to manufacture lab panels with excellent mechanical properties using the PMF resin system without an acid catalyst. In fact the board properties were highest without the addition of catalyst. Furthermore the data seem to suggest that in the presence of high levels of catalyst (9%) the board properties are reduced in the presence of the fire retardant treatment. The data support the hypothesis that an acid is generated from the fire retardant component during the press cycle and that this acid component is able to cure the PMF resin system, producing good bonding between the flakes.

TABLE 2

Resin catalyst interaction

| Catalyst % | | Density, pcf (g/cm$^3$) | MOE, psi (KN/cm$^2$) | MOR, psi (N/cm$^2$) | Density, pcf (g/cm$^3$) | IB PSI (N/cm$^2$) (except n) |
|---|---|---|---|---|---|---|
| 0 | Mean | 47.0 (0.753) | 695,000 (479) | 3413 (2353) | 47.2 (0.756) | 64.9 (44.7) |
| | s.d. | 4.9 (0.078) | 264,000 (182) | 1855 (1279) | 5.8 (0.093) | 17.5 (12.1) |
| | n | 6 | 6 | 6 | 14 | 14 |
| 3 | Mean | 46.6 (0.746) | 620,000 (427) | 3409 (2351) | 48.2 (0.772) | 55.9 (38.5) |
| | s.d. | 3.9 (0.062) | 45,000 (31) | 12 (8.3) | 4.7 (0.075) | 16.2 (11.2) |
| | n | 6 | 6 | 6 | 14 | 14 |
| 6 | Mean | 45.1 (0.722) | 637,000 (439) | 3622 (2497) | 44.5 (0.713) | 57.6 (39.7) |
| | s.d. | 2.4 (0.038) | 132,000 (91) | 968 (667) | 5.0 (0.080) | 22.0 (1.4) |
| | n | 6 | 6 | 6 | 14 | 14 |
| 9 | Mean | 47.0 (0.753) | 629,000 (434) | 3346 (2307) | 49.8 (0.798) | 49.2 (33.9) () |
| | s.d. | 2.2 (0.035) | 151,000 (104) | 1253 (864) | 3.0 (0.048) | 11.1 (7.65) |
| | n | 6 | 6 | 6 | 14 | 14 |

s.d. = Standard deviation
n = number of samples

High Temperature/Humidity Performance

On the assumption that the data in Table 2 are valid and can be explained by the production of an acid component created from the fire retardant under the elevated press temperatures and, based on the chemistry of the fire retardant formulation it is likely that acid component is phosphoric acid, then it raises the question of whether or not the acid will attack the structural integrity of the finished board in service. In an attempt to resolve the issue fire retardant and untreated panels were placed in under conditions of high temperature and humidity for a period of 28 days in a procedure roughly equivalent to that proscribed in ASTM standard D5516. Test panels were manufactured using the procedures described earlier. Aspen/birch flakes were sprayed with Comptrol™ concentrate so as to achieve a face and core loading of 6% m/m $P_2O_5$ in the finished panel. Treated and untreated panels were conditioned at 90-95% RH and a temperature of 175° F. for a period of 28 days. At the end of the exposure period the panels were removed and tested to determine the residual strength and stiffness. Comparisons were made with matched panels maintained at ambient temperature and humidity in an air-conditioned laboratory. Results are presented in Table 3.

The data indicated that the strength reduction in the treated panels is equivalent to that observed with untreated OSB. This suggests that degradation of the structural integrity of the fire retardant treated OSB due to acids generated in the press or due to long term exposure to high temperature and humidity in service is not a significant problem.

TABLE 3

High temperature/humidity strength reduction

| Sample | % MOE retention | % MOR retention |
|---|---|---|
| 6/6 FR ½inch (13 mm) | 111 | 91 |
| Untreated control | 87 | 96 |

Preliminary Chemical Analysis of the Products Formed During Pressing

To learn more about the nature of the compound formed in the press from the combination of resin, catalyst and fire retardant and the resin/catalyst/fire retardant interaction in general, the components were mixed in various combinations in a series of in-vitro experiments. Essentially this involved weighing out resin, catalyst and fire retardant into beakers, mixing thoroughly and then heating the mixtures in an oven until fully reacted. The quantities of resin, catalyst and fire retardant used were kept constant at the levels indicated below.

ARC 9707 PMF resin 4.5% resin solids

ARC 9700 acid catalyst 5.0% based on liquid resin addition

Comptrol™ FR 6.0% m/m $P_2O_5$ basis

The FRT and resin were combined and on a 250 grams solution basis in disposable beakers. Where a catalyst was needed the amount added was based on resin solution, 2.56 grams. The resin and catalyst sample alone was mixed to 250 grams solution basis. The powdered Comptrol™ (made by drying the liquid concentrate) was added to the resin solution then catalyst added if called for. Once thoroughly mixed, part of each sample was poured into a clean glass jar. These jars were placed in a forced air oven at 380° F. (193° C.) until the jar containing the sampled solidified. This varied from 15 minutes to about 45 minutes depending on the use of a catalyst (or not).

The levels of boron and phosphorus in the reacted mixture were analyzed using standard analytical chemical procedures. Of particular interest was the relative solubility of the reacted mixture in water. Results for extracted and non-extracted samples are presented in Table 4.

Whenever Comptrol™ was present in the mixture an amorphous yellow compound was formed. The yellow compound was absent in sample 1.

The ratio of phosphorus to boron in Comptrol™ concentrate is approximately 3.2:1 based on $P_2O_5$ and boric acid equivalence. It is well known that Comptrol™ is readily leached by water from pressure treated lumber and plywood. The absolute concentrations of P and B in sample 1 which contains no Comptrol™ fire retardant are very low. The P to B ratio in sample 1 is approximately 5. These values presumably reflect background levels inherent in the resin catalyst chemistry. Table 4 shows that the P to B ratio for sample 1 did not change after extraction.

Samples 3 and 4, by virtue of the fact that powdered Comptrol™ was used in the blend, most closely approximated the chemical environment present on the treated flakes.

The absolute concentrations of P and B in samples 2, 3 and 4 (all of which contained the Comptrol™ fire retardant)

varied widely before extraction. However, the P to B ratios for the three samples were similar to that expected from the Comptrol™ concentrate, suggesting that the observed values reflect the presence of fire retardant and not an aberration due to background levels.

After extraction the total boron and phosphorus levels in samples 2, 3 and 4 decreased. This indicated that these components were at least partially dissolved by the water. The percentage loss of phosphorus was least in sample 3 which contained no catalyst. The ratio of P to B in sample 3 after extraction was much greater than the ratios of P to B in samples 2 and 4. Potentially this result seems to suggest that in the absence of catalyst the propensity of the fire retardant to leach is greatly reduced. Conceptually this may maintain the fire retardant properties of Comptrol™ treated under service conditions and it also supports the hypothesis that the fire retardant is able to chemically react with the resin system producing novel compounds resistant to leaching liquid water.

TABLE 4

In-vitro resin/catalyst/FR interactions

| Sample | Phosphorus Conc. (as % $P_2O_5$) Pre-extraction | Boron Conc. (as % $H_3BO_3$) Pre-extraction | P:B ratio Pre-extraction | Phosphorus Conc. (as % $P_2O_5$) Post Extraction | Boron Conc. (as % $H_3BO_3$) Post Extraction | P:B ratio Post Extraction |
|---|---|---|---|---|---|---|
| | 23.7 | 7.5 | 3.2 | | | |
| 1 | 0.311 | 0.062 | 5 | 0.242 | 0.045 | 5.4 |
| 2 | 11.6 | 4.26 | 2.7 | 0.398 | 1.07 | 0.37 |
| 3 | 2.18 | 0.557 | 3.9 | 1.11 | 0.534 | 2.1 |
| 4 | 14.6 | 4.05 | 3.6 | 1.02 | 1.63 | 0.6 |

Sample 1: Liquid PMF resin + acid catalyst
Sample 2: Liquid PMF resin + catalyst + liquid Comptrol ™ FR
Sample 3: Liquid PMF resin, no catalyst + powdered Comptrol ™ FR
Sample 4: Liquid PMF resin + catalyst + powdered Comptrol ™ FR

EXAMPLE 3

Extended Burn Testing

To extend confidence in the fire retardant properties of Comptrol™ treated OSB, additional panels were fabricated using the PMF resin, catalyst and Comptrol™ concentrate. The blending, drying and press parameters were essentially identical to those previously described for Example 1. Mixed aspen and birch flakes sprayed with sufficient Comptrol™ concentrate to achieve a range of final face and core loadings in the finished panels as listed below:

- 2/2 2% m/m $P_2O_5$ face and core ⅝" (16 mm) panel thickness
- 4/2 4% m/m $P_2O_5$ face and 2% m/m $P_2O_5$ core ⅝" (16 mm) panel thickness
- 6/2 6% m/m $P_2O_5$ face and 2% m/m $P_2O_5$ core ⅝" (16 mm) panel thickness
- 6/6 6% m/m $P_2O_5$ face and 6% m/m $P_2O_5$ core ⅜" (10 mm) panel thickness
- Untreated controls ⅜ (10 mm) and ⅝" (16 mm) panel thickness ARC 9707 resin catalyzed with 6.5% ARC 9700 acid catalyst was applied to each batch of flakes at an addition rate of 4.5%, based on resin solids and oven-dry weight of the strands and Comptrol™ mix. Similarly the amount of wax emulsion applied to each batch of flakes was kept constant at an addition rate of 1.0%. Resinated flakes were formed into 24" mats and pressed into panels. Enough panels were made for each retention level and thickness combination to provide material for bum testing and to evaluate the physical and mechanical properties.

The burn testing was carried out using the UL723 (ASTM E 84) flame tunnel protocol at Underwriters Laboratories located in Northbrook Illinois. A summary of the burn test results is provided in FIG. 1. Mechanical and physical property evaluations are summarized in Tables 5And 5B.

FIG. 1 illustrates that the fire retardant treatment provided a significant improvement over untreated OSB when subjected to 24-foot (7.3 m) flame tunnel test. As expected the untreated OSB generated considerable smoke and a very high flame spread rating. Smoke ratings for the Comptrol™ treated material were generally low and well within acceptable criteria irrespective of the fire retardant loading. Flame spread indices were lowest for the ⅝" (16 mm) panel treated with a 6% face and 2% core loading with a value of 30, qualifying the material for a class B fire rating.

Tables 5A, 5B and 5C illustrate that the panel physical and mechanical properties are conserved after the Comptrol™ treatment.

TABLE 5A

Water absorption/Thickness swell

| Sample (Face/core loading % m/m $P_2O_5$) | Density, pcf ($g/cm^3$) | Water absorption | % swell |
|---|---|---|---|
| 6/2 ⅝" (16 mm) | 45.6 (0.730) | 28.6 | 11.3 |
| 4/2 ⅝" (16 mm) | 45.2 (0.724) | 30.6 | 11.7 |
| Control PMF resin ⅝" (16 mm) | 46.2 (0.740) | 23.3 | 9.7 |
| Control PF resin ⅝" (16 mm) | 47.0 (0.753) | 1.9 | 12.5 |

TABLE 5B

Internal Bond

| Sample (face/core loading) | Density | Internal Bond |
|---|---|---|
| 6/2 ⅝" (16 mm) | 46.4 (s.d. 3.2) pcf<br>0.743 (s.d. 0.051) $g/cm^3$ | 56.0 (s.d. 17.2) psi<br>38.6 (s.d. 11.9) $N/cm^2$ |
| 4/2 ⅝" (16 mm) | 47.9 (s.d. 2.8) pcf<br>0.767 (s.d. 0.045) $g/cm^3$ | 67.8 (s.d. 19.0) psi<br>46.7 (s.d. 13.1) $N/cm^2$ |
| Control PMF resin ⅝" (16 mm) | 45.9 (s.d. 2.7) pcf<br>0.735 (s.d. 0.043) $g/cm^3$ | 72.3 (s.d. 20.0) psi<br>49.9 (s.d. 13.8) $N/cm^2$ |
| Control PF resin ⅝" (16 mm) | 45.1 (s.d. 3.9) pcf<br>0.722 (s.d. 0.062) $g/cm^3$ | 62.2 (s.d. 14.3) psi<br>42.9 (s.d. 9.85) $N/cm^2$ |

TABLE 5C

Static bending

| Sample (face/core loading) | Density | MOE | MOR |
|---|---|---|---|
| 6/2 ⅝" (16 mm) | 44.8 (s.d. 1.6) pcf<br>0.718 (s.d. 0.026) $g/cm^3$ | 729,757<br>(s.d. 105,731) psi<br>503 (s.d. 73) $KN/cm^2$ | 3616 (s.d. 352) psi<br>2493 (s.d. 243) $N/cm^2$ |
| 4/2 ⅝" (16 mm) | 44.5 (s.d. 2.1) pcf<br>0.713 (s.d. 0.034) $g/cm^3$ | 634,743<br>(s.d. 181,654) psi<br>437 (s.d. 125) $KN/cm^2$ | 2915 (s.d. 834) psi<br>2010 (s.d. 575) $N/cm^2$ |
| Control PMF resin ⅝" (16 mm) | 44.1 (s.d. 1.9) pcf<br>0.706 (s.d. 0.030) $g/cm^3$ | 802,885<br>(s.d. 255,177) psi<br>554 (s.d. 176) $KN/cm^2$ | 4865 (s.d. 1688) psi<br>3354 (s.d. 1164) $N/cm^2$ |
| Control PF resin ⅝" (16 mm) | 46.8 (s.d. 0.9) pcf<br>0.749 (s.d. 0.014) $g/cm^3$ | 820,873<br>(s.d. 117,322) psi<br>566 (s.d. 81) $KN/cm^2$ | 5131 (s.d. 987) psi<br>3538 (s.d. 681) $N/cm^2$ |

EXAMPLE 4

Fungicide and Termiticide Efficacy

The termiticidal and fungicidal properties of boron compounds have been known and documented for many years. It is known that wood treated with boron to a retention of 1% m/m boric acid equivalent (BAE) will be resistant to decay provided that the material is not exposed to liquid water that would promote leaching. Similar retentions of boron are known to control termite feeding. The American Wood Preservation Association standards specify a retention of 0.28 pcf $B_2O_3$ for solid wood and plywood used in areas where Formosan termites are present and 0.17 pcf $B_2O_3$ in regions where *Reticulitermes* is prevalent. These values convert to 1.8 and 1% m/m BAE respectively.

Comptrol™ concentrate contains both phosphorus and boron in a 3.2 to 1 ratio when expressed on a $P_2O_5$ to $H_3BO_3$ basis. The inventors have found that if the Comptrol™ is used in a high enough retention such that the boron level in the treated wood is equal to or exceeds that required for termite and decay control then the fire retardant formulation confers some degree of protection. Two laboratory studies with Comptrol™ treated solid southern pine have confirmed this. Results from these studies conducted by the Mississippi State University Forest Products Laboratory are summarized in Table 6And 6B.

TABLE 6A

Laboratory termite test results using SYP sapwood

| Comptrol ™ Retention, pcf (g/cm$^3$) $P_2O_5$ | Block rating* |
|---|---|
| 1.04 (0.0167) | 9.8 |
| 0.66 (0.011) | 10.0 |
| 0.31 (0.00497) | 10.0 |
| 0.11 (0.00176) | 9.0 |
| 0 (control) | 2.7 |

*A rating of 10 indicates no attack; a rating of zero indicates complete destruction of the sample.

Termite Species: *Reticulitermes flavipes*

Test Procedure:—ASTM D3345-74

Test conducted by:—Mississippi State University Forest Products Laboratory

TABLE 6B

Laboratory decay test

| Solution Conc (% $P_2O_5$) | Retention of Comptrol ™ in test blocks, pcf (g/cm$^3$) $P_2O_5$ | Average weight loss (%)* |
|---|---|---|
| 0.0 | 0 | 48.2 ± 3.6 |
| 0.25 | 0.11 (0.00176) | 23.3 ± 10.7 |
| 0.75 | 0.32 (0.0051) | 5.8 ± 1.7 |
| 1.5 | 0.65 (0.0104) | 7.2 ± 2.2 |
| 2.5 | 1.07 (0.0171) | 7.6 ± 0.3 |

*A weight loss of 5% is considered a significant positive result.

Test Fungus: *Gloeophyllum trabeum*

Test Procedure: ASTM D1413 soil block test without leaching

By inference a Comptrol™ loading of 6% m/m $P_2O_5$ in OSB deposits boron at a level of 1.9% m/m BAE equivalence in the same panel. The inventors contemplate that OSB treated to a $P_2O_5$ loading between 4 and 6% m/m will be resistant to both decay and termite attack.

What is claimed is:

1. A method of farming a fire-retardant wood-based composite, comprising the steps of:

A. providing a green wood furnish;

B. treating the green wood furnish with an amount of a phosphate/borate fire retardant treatment effective to increase the fire retardancy of the resulting wood-based composite, compared to the fire retardancy of the corresponding wood-based composite lacking the fire retardant;

C. optionally, drying the treated green wood furnish to a moisture content suitable for fabrication of the wood-based composite;

D. blending the treated green wood furnish with a binder; and

E. binding the green wood furnish with said binder to form a fire-retardant wood based composite.

2. The method of claim 1, further comprising, during or alter said fire retardant treatment, applying a water repellent material to said green wood furnish to form treated wood particles.

3. The method of claim 2, wherein said fire retardant treatment and said water repellent are applied from a single emulsion.

4. The method of claim 2, wherein said water repellent material is a paraffinic wax.

5. The method of claim 2, wherein said water repellant is slack wax.

6. The method of claim 1, wherein said green wood furnish comprises aspen flakes.

7. The method of claim 1, wherein said green wood furnish has a moisture content of from about 60% to about 100%, based on dry wood weight, just before said fire retardant applying step.

8. The method of claim 1, wherein said phosphate is an inorganic phosphate.

9. The method of claim 1, wherein said fire retardant treatment is applied from an aqueous dispersion.

10. The method of claim 1, wherein said binder is a phenolic resin.

11. The method of claim 1, wherein said binder is a urea-formaldehyde resin.

12. The method of claim 1, wherein said binder is a catalyst-curable phenol-melamine-formaldehyde resin.

13. The method of claim 12, wherein said fire retardant treatment is present in an amount effective to at least partially catalyze the cure of said binder.

* * * * *